US005353769A

United States Patent [19]

Maeda et al.

[11] Patent Number: 5,353,769

[45] Date of Patent: Oct. 11, 1994

[54] FUEL SUPPLY CONTROL SYSTEM FOR INTERNAL COMBUSTION ENGINES

[75] Inventors: Kenichi Maeda; Yuichi Shimasaki; Eitetsu Akiyama; Takashi Hisaki; Shigeru Maruyama; Masaki Kanehiro; Takuji Ishioka; Kazutomo Sawamura, all of Wako, Japan

[73] Assignee: Honda Giken Kogyo Kabushiki Kaisha, Tokyo, Japan

[21] Appl. No.: 51,678

[22] Filed: Apr. 23, 1993

[30] Foreign Application Priority Data

Apr. 24, 1992 [JP] Japan ..... 4-131500

[51] Int. Cl.[5] ..... F02D 41/14; F02P 17/00

[52] U.S. Cl. ..... 123/492; 123/493

[58] Field of Search ..... 123/479, 481, 492, 493, 123/630, 478; 324/388, 399

[56] References Cited

U.S. PATENT DOCUMENTS 4,327,689 5/1982 Rachel ..... 123/491 X 4,989,554 2/1991 Kushida et al. ..... 123/479 X 5,174,261 12/1992 Fujii et al. ..... 123/479 X 5,213,081 5/1993 Fujimoto ..... 123/481 X 5,215,067 6/1993 Shinasaki et al. ..... 123/630

5,226,394 7/1993 Shimasaki et al. ..... 123/479

5,241,937 9/1993 Kanehiro et al. ..... 123/630 X

*Primary Examiner*—Tony M. Argenbright

*Attorney, Agent, or Firm*—Nikaido, Marmelstein, Murray & Oram

[57] ABSTRACT

A fuel supply control system which controls an amount of fuel supplied to an internal combustion engine. An ECU detects a value related to an amount of combustion ions generated within cylinders. The detected value is compared with a predetermined value, and the amount of fuel supplied to the engine is corrected based upon the comparison result, when the engine is in a transient operating condition, such as acceleration and deceleration, whereby the responsiveness of the air-fuel ratio feedback control is enhanced to improve drivability and exhaust emission characteristics.

6 Claims, 9 Drawing Sheets

FUEL SUPPLY CONTROL SYSTEM FOR INTERNAL COMBUSTION ENGINES

BACKGROUND OF THE INVENTION

1. Field of the Invention

This invention relates to a fuel supply control system for internal combustion engines, and more particularly to fuel supply control applied during transient operating conditions of the engine such as acceleration and deceleration.

2. Prior Art

Conventionally, it has been generally employed to detect accelerating/decelerating conditions of an internal combustion engine, based upon an amount of change in the opening of a throttle valve and increase an amount of fuel supplied to the engine (fuel supply amount) at acceleration of the engine and decrease the same at deceleration of the engine.

It has also been generally employed to carry out feedback control of a fuel supply amount in response to an output from an oxygen concentration sensor arranged in an exhaust system of an internal combustion engine. The feedback control is also carried out at acceleration and deceleration of the engine.

However, the incremental value and decremental value by which the fuel supply amount is increased and decreased at acceleration and deceleration of the engine are previously set in accordance with change amounts in the throttle valve opening or the like. As a result, the air-fuel ratio of a mixture actually supplied to the engine can temporarily deviate from a desired value, depending upon variations in operating characteristics between engines and/or the properties of fuel used such as gasoline. If the feedback control responsive to the output from the oxygen concentration sensor is carried out with high responsiveness, such deviation in the air-fuel ratio might be corrected. However, in actuality, there is a significant time lag from the time the mixture is burned within a cylinder of the engine to the time the resulting combustion gas reaches the oxygen concentration sensor when a change in the oxygen concentration in the combustion gas is detected, making it difficult to completely correct the deviation in the air-fuel ratio.

For example, let it be assumed that the throttle valve is suddenly opened such that the throttle valve opening $\theta$TH changes as indicated in FIG. 1 (*a*). Then, the output from the oxygen concentration sensor does not cause a change in the fuel supply amount until after a time point t1 when a change in the output from the oxygen concentration sensor causes a change in the fuel supply amount. As a result, the air-fuel ratio of the mixture first changes toward a leaner side and then toward a richer side after the time point t1. This results in degradation in exhaust emission characteristics of the engine as well as in drivability thereof. In FIG. 1 (*b*), symbol TD1 represents a time lag from the time the mixture is burned within a cylinder of the engine to the time the resulting combustion gas reaches the oxygen concentration sensor when a change in the oxygen concentration in the combustion gas is detected.

SUMMARY OF THE INVENTION

It is the object of the invention to provide a fuel supply control system for an internal combustion engine, which is capable of controlling the air-fuel ratio of a mixture supplied to the engine under a transient operating condition with high responsiveness, to thereby improve drivability and exhaust emission characteristics of the engine, etc.

To attain the above object, the present invention provides a fuel supply control system for controlling an amount of fuel supplied to an internal combustion engine having at least one cylinder, comprising:

combustion ion-detecting means for detecting a value related to an amount of combustion ions generated within the at least one cylinder;

engine operating condition-detecting means for detecting whether the engine is in a transient operating condition; and correcting means for comparing the value related to the amount of combustion ions with a predetermined value and for correcting an amount of fuel supplied to the engine, based upon a result of the comparison, when it is detected that the engine is in the transient operating condition.

In a preferred embodiment of the invention, there is provided a fuel supply control system for controlling an amount of fuel supplied to an internal combustion engine having at least one cylinder, and an ignition system having a spark plug mounted in each of the at least one cylinder, signal generating means for generating an ignition command signal indicative of ignition timing dependent upon operating conditions of the engine, and sparking voltage-generating means responsive to the ignition command signal for generating sparking voltage in the at least one cylinder for discharging the spark plug, the fuel supply control system comprising:

voltage value-detecting means for detecting a value of the sparking voltage generated by the sparking voltage-generating means in response to the ignition command signal;

measuring means for measuring an extent to which the value of the sparking voltage detected by the voltage-detecting means exceeds a first predetermined value; and correcting means for comparing the extent measured by the measuring means with a second predetermined value, and for correcting an amount of fuel supplied to the engine, based upon a result of the comparison.

Preferably, the extent to which the detected value of the sparking voltage exceeds the first predetermined value is a time period over which the former exceeds the latter.

Further preferably, the second predetermined value is set in dependence on operating conditions of the engine.

The above and other objects, features, and advantages of the invention will become more apparent from the following detailed description taken in conjunction with the accompanying drawings.

BRIEF DESCRIPTION OF THE DRAWINGS

FIGS. 1 (*a*)-(*c*) collectively form a timing chart showing changes in the air-fuel ratio of a mixture supplied to an internal combustion engine with a change in the opening $\theta$TH of a throttle valve of the engine, in which:

FIG. 1 (*a*) shows a change in the throttle valve opening $\theta$TH;

FIG. 1 (*b*) shows a change in the air-fuel ratio resulting from the change in the throttle valve opening $\theta$TH, according to the prior art; and FIG. 1 (*c*) is a similar view to FIG. 1 (*b*), according to the present invention;

DETAILED DESCRIPTION

The invention will now be described in detail with reference to the drawings showing an embodiment thereof.

Figure 2:
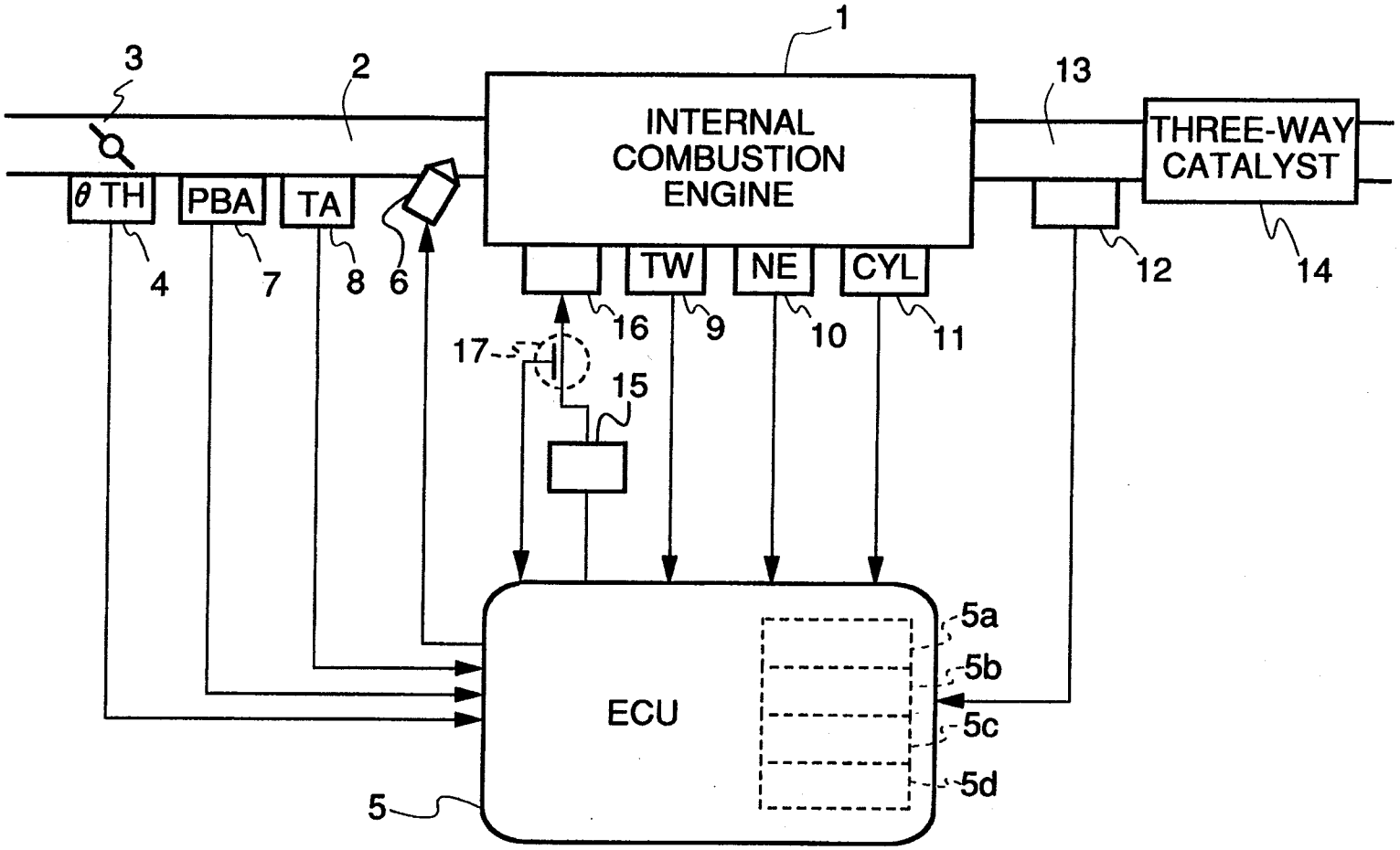
FIG. 2 is a block diagram showing the whole arrangement of an internal combustion engine and a control system therefor, including a fuel supply control system according to an embodiment of the invention.

Referring first to FIG. 2, there is shown the whole arrangement of an internal combustion engine provided with a control system therefor including a fuel supply control system according to an embodiment of the invention. A throttle valve 3 is arranged in an intake pipe 2 of the engine 1, which is a four-cylinder type, for example. A throttle valve opening (θTH) sensor 4 is connected to the throttle valve 3 for generating an electric signal indicative of the sensed throttle valve opening and supplying the same to an electronic control unit (hereinafter referred to as "the ECU") 5.

Fuel injection valves 6 are each provided for each cylinder and arranged in the intake pipe 2 at a location intermediate between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

A spark plug 16 of each cylinder of the engine is electrically connected to the ECU 5 via a distributor 15 to have it spark ignition timing controlled by a control signal (ignition command signal) therefrom. A sparking voltage sensor 17 is provided at an intermediate portion of a connecting line which connects between the distributor 15 and the spark plug 16. The sensor 17 is electrostatically coupled to the connecting line and forms together therewith a capacitance of several pF's, and its output is connected to the ECU 5.

On the other hand, an intake pipe absolute pressure (PBA) sensor 7 is arranged in the intake pipe 2 at a location immediately downstream of the throttle valve 3, for supplying an electric signal indicative of the sensed absolute pressure PBA to the ECU 5. An intake air temperature (TA) sensor 8 is inserted into the intake pipe 2 at a location downstream of the intake pipe absolute pressure sensor 7 for supplying an electric signal indicative of the sensed intake air temperature TA to the ECU 5.

An engine coolant temperature (TW) sensor 9, which may be formed of a thermistor or the like, is mounted in the coolant-filled cylinder block of the engine 1 for supplying an electric signal indicative of the sensed engine coolant temperature TW to the ECU 5. An engine rotational speed (NE) sensor 10 and a cylinder-discriminating (CYL) sensor 11 are arranged in facing relation to a camshaft or a crankshaft of the engine 1, neither of which is shown. The engine rotational speed sensor 10 generates a pulse as a TDC signal pulse at each of predetermined crank angles whenever the crankshaft rotates through 180 degrees, while the cylinder-discriminating sensor 11 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and NOx. An oxygen concentration sensor 12 is mounted in the exhaust pipe 13 at a location upstream of the three-way catalyst 14, for supplying an electric signal having a level approximately proportional to the oxygen concentration in the exhaust gases to the ECU 5. The oxygen concentration sensor 12 is a linear output type whose output is linearly proportional to the concentration of oxygen in the exhaust gases, but alternatively it may be a binary output type which generates an output signal assuming a high level and a low level depending upon whether or not the oxygen concentration is higher than a predetermined value.

The ECU 5 comprises an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., an output circuit (driving circuit) 5*d* which outputs a driving signal to the fuel injection valves 6, and the ignition command signal A to the spark plug 16**, etc.

The CPU **5*b* calculates the valve opening period or fuel injection period Tout of the fuel injection valves 6 and ignition timing θIG of the spark plug 16** in response to operating parameter signals from operating parameter sensors as mentioned above, by the use of the following equations (1) and (2);

$$TOUT = TI \times KMF \times KLAF \times KDEC \times K1 + TACC + K2 \quad (1)$$

$$\theta TH = \theta IGMAP + \theta IGCR \quad (2)$$

where TI and θIGMAP represent a basic fuel injection period and basic ignition timing, respectively, which are determined from maps which are both based upon engine rotational speed NE and intake pipe absolute pressure PBA and stored in the memory means **5*c* of the ECU 5**.

KMF represents a transient operation correction coefficient which is determined based upon a waveform of sparking voltage which is generated within each cylinder of the engine and detected by the sparking voltage sensor 17, to effectively correct the air-fuel ratio of a mixture supplied to the engine when the engine is in a transient operating condition such as acceleration and deceleration.

KLAF represents an air-fuel ratio feedback correction coefficient which is determined based upon an output from the oxygen concentration sensor 12 and other operating parameter signals.

KDEC represents a deceleration correction coefficient for decreasing the fuel supply amount when the engine is in a decelerating condition. For example, it is determined based upon a variation DTH in the throttle valve opening θTH (difference between a present value of the throttle valve opening and an immediately preceding value thereof, detected or sampled at predetermined time intervals).

TACC represents an acceleration correction variable for increasing the fuel supply amount when the engine is in an accelerating condition. For example, it is determined based upon the variation DTH in the throttle valve opening θTH.

K1, K2 and θIGCR are other correction coefficients, other correction variables and θIG-correction variables, respectively, which are determined based upon various engine operating parameter signals.

The CPU **5*b* supplies the fuel injection valves 6 and the spark plugs 16 with respective driving signals based on the results of calculations carried out as above, through the output circuit 5*d***.

Figure 3:
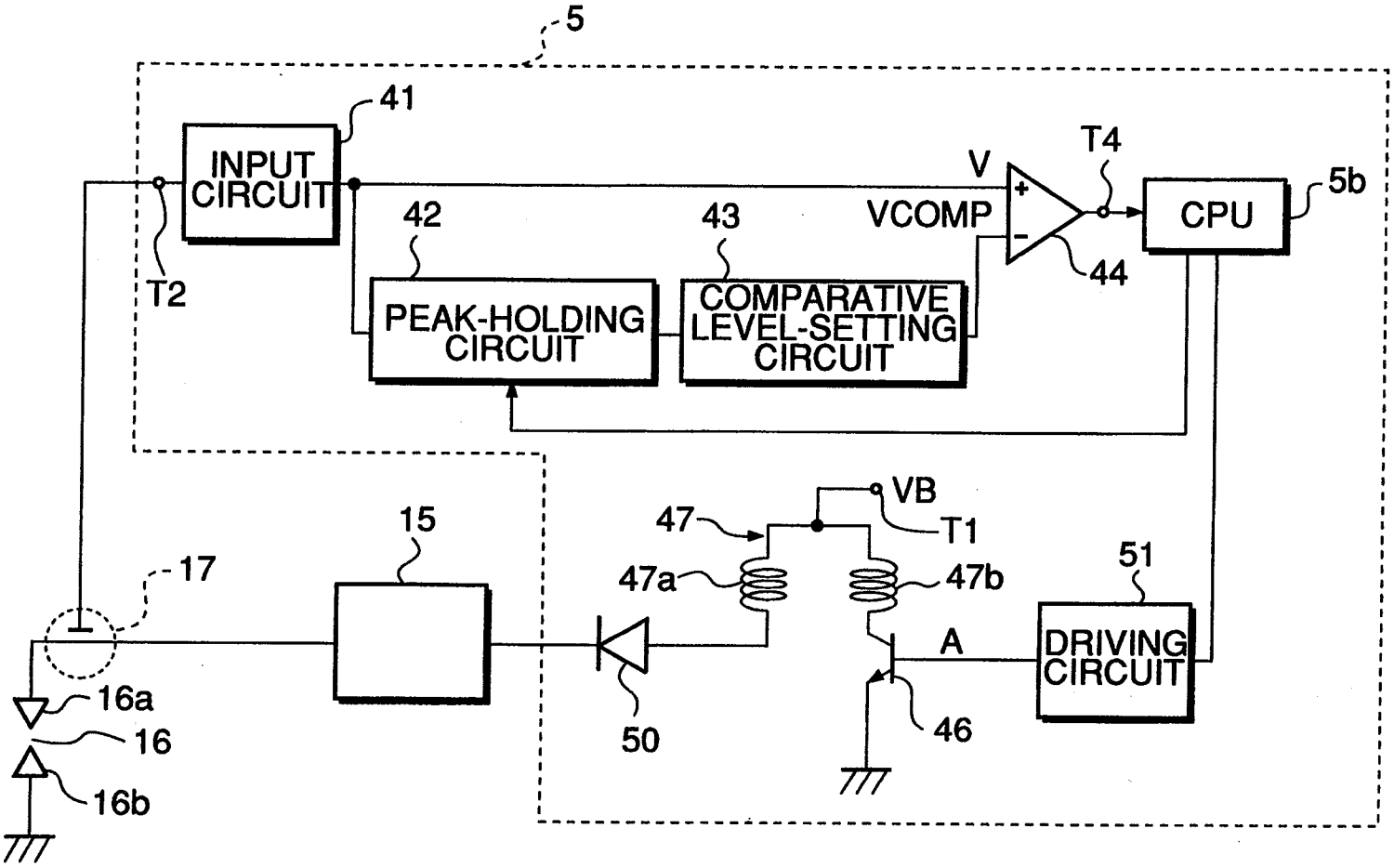
FIG. 3 is a schematic circuit diagram showing the arrangement of a circuit incorporated in the fuel supply control system, for detecting a value of a parameter indicative of an amount of combustion ions generated within a cylinder.

FIG. 3 shows the arrangement of a circuit incorporated in the fuel supply control system according to the present embodiment, for detecting a value of a parameter indicative of an amount of combustion ions generated within each cylinder. A feeding terminal T1, which is supplied with supply voltage VB from a battery, not shown, is connected to an ignition coil 47 comprised of a primary coil **47*a* and a secondary coil 47*b*. The primary and secondary coils 47*a*, 47*b* are connected with each other at ends thereof. The other end of the primary coil 47*a* is connected to a collector of a transistor 46. The transistor 46 has its base connected via the driving circuit 5*d* to the CPU 5*b* and its emitter grounded. The base of the transistor 46 is supplied with the ignition command signal A from the CPU 5*b*. The other end of the secondary coil 47*b* is connected via the distributor 15 to a center electrode 16*a* of the spark plug 16. The spark plug 16 has its grounding electrode 16*b*** grounded.

The sparking voltage sensor 17 is connected via an input circuit 41 to a peak-holding circuit 42 and a non-inverting input terminal of a comparator 44. The output of the peak-holding circuit 42 is connected via a comparative level-setting circuit 43 to an inverting input terminal of the comparator 44. The peak-holding circuit 42 has a resetting input connected to the CPU **5*b* and supplied with a resetting signal for resetting at an appropriate time a peak value of the sparking voltage held by the peak-holding circuit 42. A diode 50 is connected between the secondary coil 47*b* and the distributor 15**.

Figure 4:
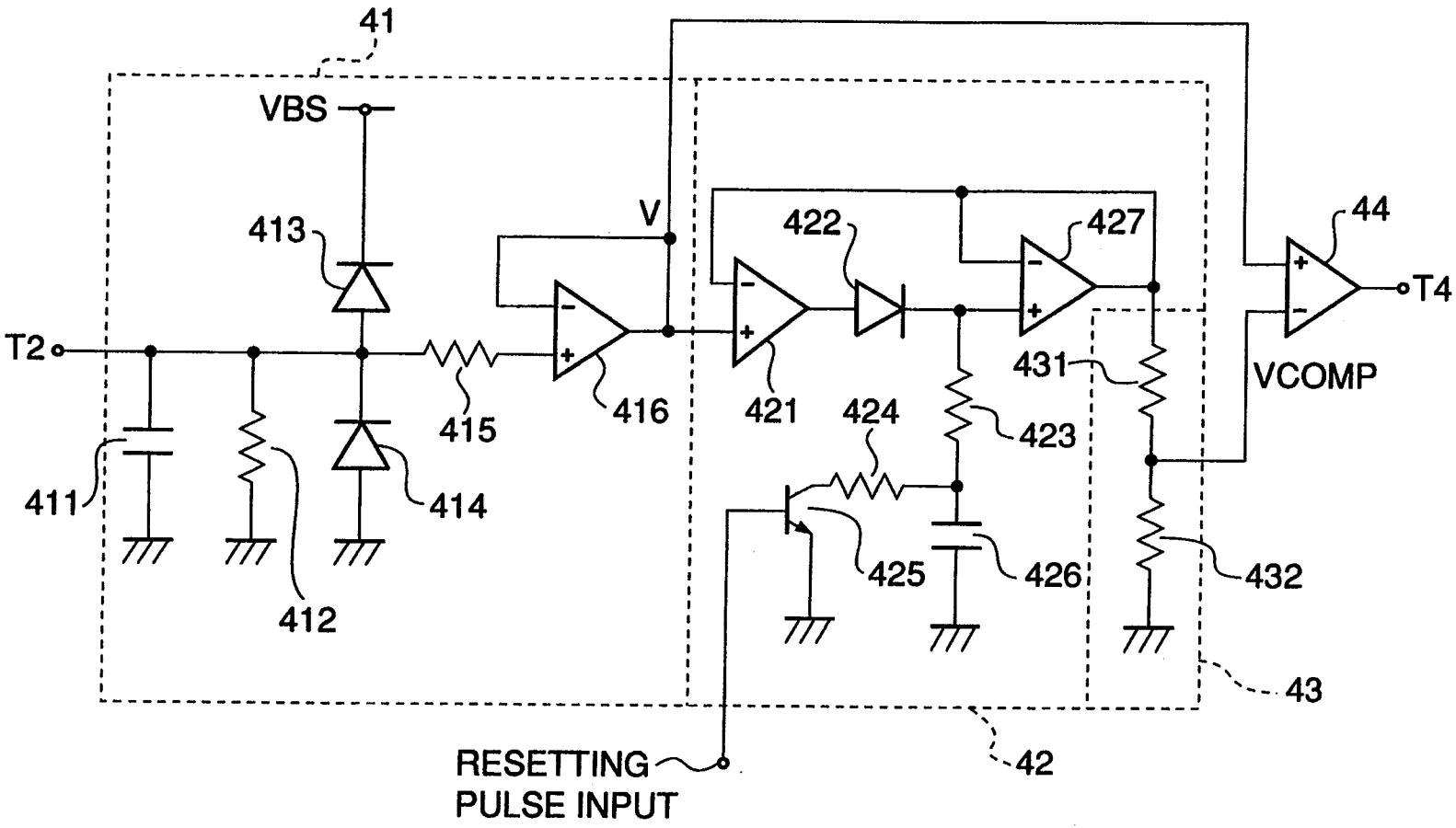
FIG. 4 is a circuit diagram showing details of the circuit of FIG. 2.

FIG. 4 shows details of the input circuit 41, the peak-holding circuit 42, and the comparative level-setting circuit 43. In the figure, the input terminal T2 is connected to a non-inverting input terminal of an operational amplifier 416 via a resistance 415. The input terminal T2 is also grounded via a circuit formed of a capacitor 411, a resistance 412, and a diode 414, which are connected in parallel, and connected to a supply voltage-feeding line VBS via a diode 413. The capacitor 411 has a capacitance of approximately $10^4$ pF, for example and serves to divide voltage detected by the sparking voltage sensor 17 into one over several thousands. The resistance 412 has a value of approximately 500 KΩ, for example. The diodes 413 and 414 act to control the input voltage to the operational amplifier 416 to a range of 0 to VBS. An inverting input terminal of the operational amplifier 416 is connected to the output of the same so that the operational amplifier 416 operates as a buffer amplifier (impedance converter).

An output of the operational amplifier 416 is connected to the non-inverting input terminal of the comparator 44 as well as an non-inverting input terminal of an operational amplifier 421. An output of the operational amplifier 421 is connected via a diode 422 to an non-inverting input terminal of an operational amplifier 427, and inverting input terminals of the operational amplifiers 421, 427 are both connected to an output of the operational amplifier 427. Thus, these operational amplifiers operate as a buffer amplifier. A non-inverting input terminal of the operational amplifier 427 is grounded via a resistance 423 and a capacitance 426. The junction between the resistance 423 and the capacitance 426 is connected via a resistance 424 to a collector of a transistor 425. The transistor 425 has its emitter grounded and its base supplied with the resetting signal from the CPU **5*b*, which signal assumes a high level when the peak-holding circuit 422 is to be reset. The output of the operational amplifier 427 is grounded via resistances 431 and 432 forming the comparative level-setting circuit 124. The junction between the resistances 431, 432 is connected to the non-inverting input terminal of the comparator 44**.

The circuit of FIG. 4 constructed as above operates as follows: A peak value of the detected sparking voltage (output from the operational amplifier 416) is held by the peak-holding circuit 42, the held peak value is multiplied by a predetermined value smaller than 1 by the comparative level-setting circuit 43, and the resulting product is applied to the comparator 44 as a comparative level VCOMP. Thus, a pulse signal (comparison result pulse) TP, which goes high when V>VCOMP stands, is outputted from the comparator 44 through an output terminal T4.

Figure 5:
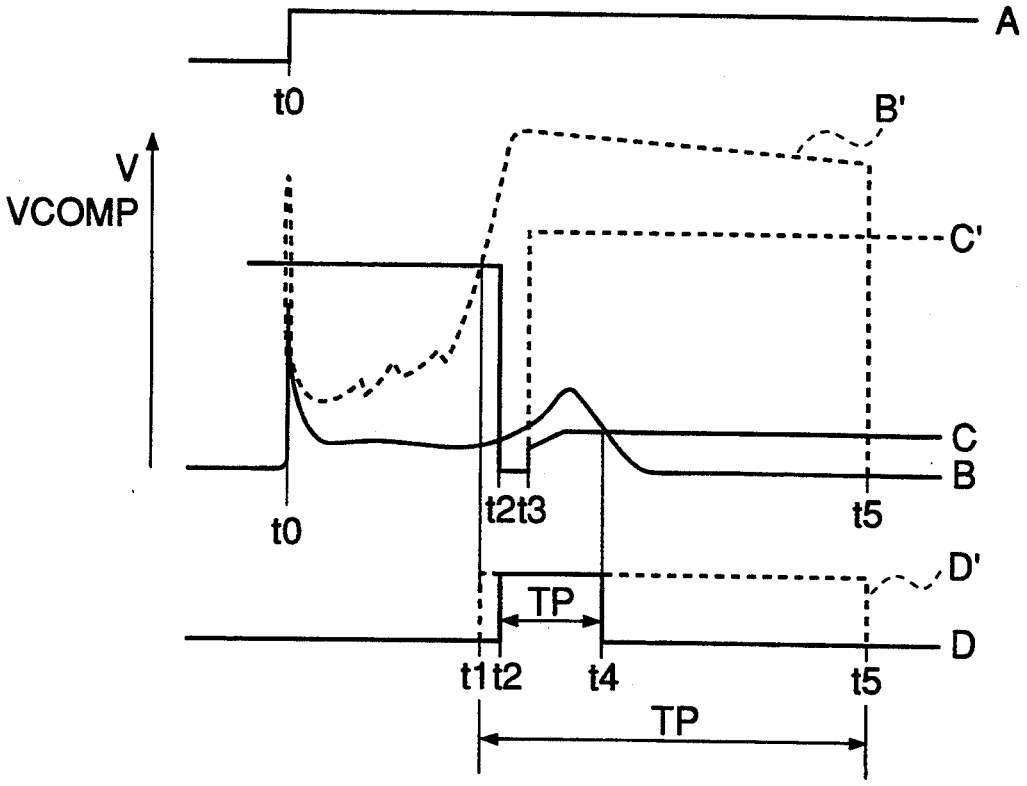
FIG. 5 is a timing chart showing changes in the sparking voltage occurring at normal firing and those occurring at a misfire.

The operation of the circuits 41–44 constructed as above will now be described with reference to FIG. 5. In FIG. 5, the solid line shows changes in the sparking voltage, which occur when the air-fuel mixture is normally fired, and the broken line changes in the sparking voltage, which occur when a misfire occurs, which is attributable to the fuel supply system (hereinafter referred to as "the FI misfire").

In FIG. 5, A shows the ignition command signal.

FIG. 5 shows changes in the detected sparking voltage (output from the input circuit 41) V (B, B') and changes in the comparative level VCOMP (C, C') with the lapse of time. First, a sparking voltage characteristic obtainable in the case of normal firing will be explained, which is indicated by the solid line:

Immediately after a time point t0 the ignition command signal A is generated, the sparking voltage V rises to such a level as to cause dielectric breakdown of the mixture between the electrodes of the spark plug, i.e. across the discharging gap of the spark plug. After dielectric breakdown of the mixture takes place, the discharge state shifts from a capacitive discharge state before the dielectric breakdown (early-stage capacitive discharge), which state has a very short duration with several hundreds amperes of current flow, to an inductive discharge state which has a duration of several milliseconds and where the sparking voltage assumes almost a constant value with several tens milliamperes of current flow. The inductive discharge voltage rises with an increase in the pressure within the engine cylinder caused by the compression stroke of the piston executed after the time point t0, since a higher voltage is required for inductive discharge to occur as the cylinder pressure increases. At the final stage of the inductive discharge, the voltage between the electrodes of the spark plug lowers below a value required for the inductive discharge to continue, due to decreased inductive energy of the ignition coil so that the inductive discharge ceases and again capacitive discharge occurs. In this capacitive discharge state (late-stage capacitive discharge), the voltage between the spark plug electrodes again rises, i.e. in the direction of causing dielectric breakdown of the mixture. However, since the ignition coil 47 then has a small amount of residual energy, the amount of rise of the voltage is small. This is because the electrical resistance of the discharging gap is low due to ionizing of the mixture during firing.

Residual charge between the electrodes of the spark plug 16, which is left after the discharge, is stored in the floating capacitance between the diode 50 and the spark plug 16. The stored residual charge is not discharged toward the ignition coil 47 due to the presence of the diode 50. But, the stored charge is neutralized by ions present in the vicinity of the electrodes of the spark plug 16, so that the sparking voltage V promptly declines after the termination of the capacitive discharge.

Next, reference is made to a sparking voltage characteristic indicated by the broken line, which is obtained when an FI misfire occurs, i.e. no firing occurs, which is caused by the supply of a lean mixture to the engine or cutting-off of the fuel supply to the engine due to failure of the fuel supply system, etc. Immediately after the time point t0 of generation of the ignition command signal A, the sparking voltage rises above a level causing dielectric breakdown of the mixture. In this case, the ratio of air in the mixture is greater than when the mixture has an air-fuel ratio close to a stoichiometric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture. Thereafter, the discharge state shifts to an inductive discharge state, as in the case of normal firing. Also, the electrical resistance of the discharging gap of the plug at the discharge of the ignition coil is greater in the case of supply of a lean mixture, etc. than that in the case of normal firing so that the inductive discharge voltage rises to a higher level than at normal firing, resulting in an earlier shifting from the inductive discharge state to a capacitive discharge state (late-stage capacitive discharge). The capacitive discharge voltage upon the transition from the inductive discharge state to the capacitive discharge state is much higher than that at normal firing, because the voltage of dielectric breakdown of the mixture is higher than that at normal firing.

On this occasion, almost no ion is present in the vicinity of the electrodes of the spark plug 16 so that the charge stored between the diode 50 and the spark plug 16 is not neutralized, nor is it allowed to flow backward to the ignition coil 47 due to the presence of the diode 50. Therefore, the charge is held as it is without being discharged through the electrodes of the spark plug 16. Then, when the pressure within the engine cylinder lowers so that the voltage between the electrodes of the spark plug 16 required for discharge to occur becomes equal to the voltage applied by the charge, there occurs a discharge between the electrodes (time point t5 in FIG. 5). Thus, even after the termination of the capacitive discharge, the sparking voltage V is maintained in a high voltage state over a longer time period than at normal firing.

The curves C, C' in FIG. 5 show changes in the comparative level VCOMP with the lapse of time, obtained from the held peak value of the sparking voltage V. The peak-holding circuit 42 is reset during time points t2 and t3. That is, the comparative level VCOMP at and before the time point t2 is one obtained in another cylinder subjected to spark ignition on the last occasion. FIG. 5 shows outputs from the comparator 44 (comparison result pulses). As is clear from FIG. 5, at normal firing, $V > VCOMP$ holds between time points t2 and t4, whereas at misfire, $V > VCOMP$ holds between time points t1 and t5, and during each of the durations, the output from the comparator 44 has a high level.

Figure 6:
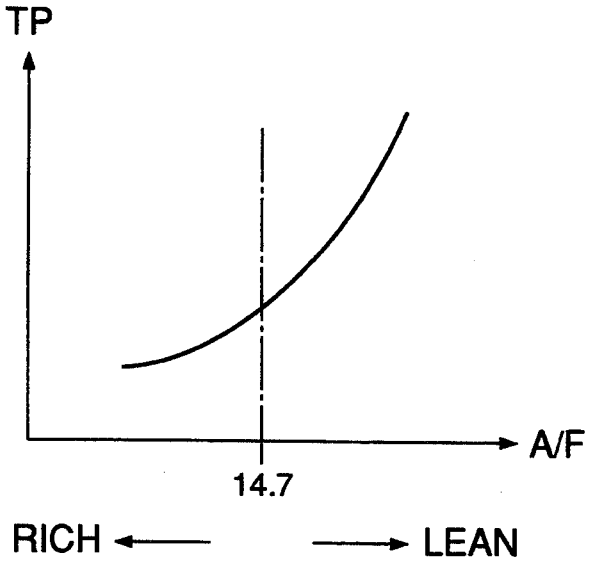
FIG. 6 is a graph showing the relationship between the air-fuel ratio A/F and the comparison result pulse width TP.

It is noted from FIG. 5 that the comparison result pulse width TP is greatly different between when normal firing has occurred and when a misfire has occurred. It has been experimentally ascertained that the comparison result pulse width TP changes with respect to the air-fuel ratio A/F of a mixture supplied to the engine, as shown in FIG. 6. The pulse width TP assumes the maximum value when a misfire has occurred. That is, the pulse width TP corresponds to the amount of ions generated within the cylinder due to combustion of the mixture (combustion ions) such that the former assumes a smaller value as the latter is greater. Therefore, by measuring the TP value, it is possible to detect the air-fuel ratio of the mixture.

Figure 7:
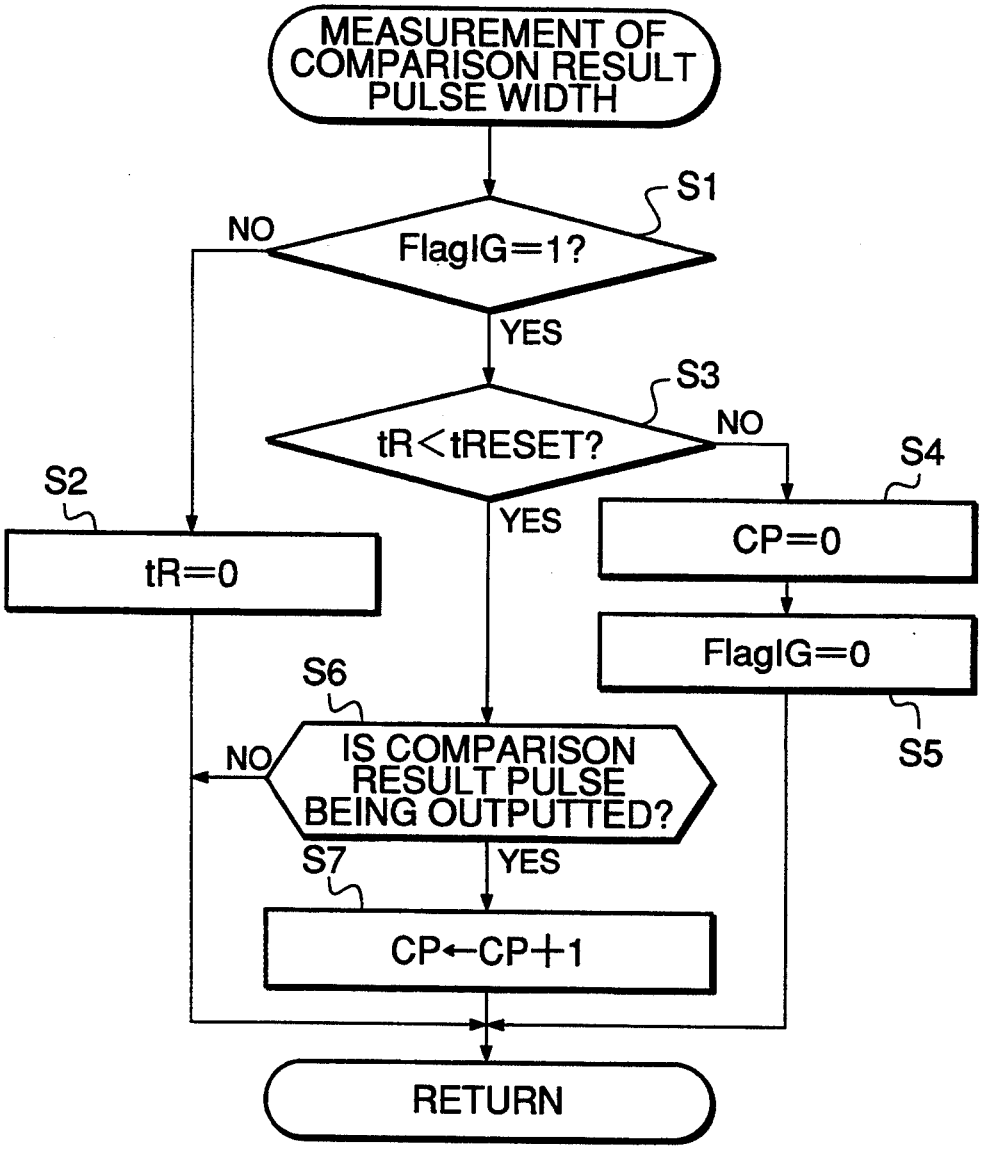
FIG. 7 is a flowchart showing a program for measuring the comparison result pulse width TP.

FIG. 7 shows a program for measuring the comparison result pulse width TP. This program is executed at fixed time intervals by the CPU 5*b*.

First, at a step S1, it is determined whether or not a flag IG is equal to "1". This flag IG is set to "1" upon generation of the ignition command signal A by a program for calculating the ignition timing. If the answer to the question of the step S1 is negative (NO), i.e. if the flag IG is equal to "0", a time value tR measured by a resetting timer is set to 0 at a step S2, followed by terminating the program. If the answer to the question of the step S1 is affirmative (YES), i.e., if the flag IG is equal to "1", it is determined at a step S3 whether or not the time value tR of the resetting timer is smaller than a predetermined value tRESET. Immediately after the flag IG has turned from "0" to to "1", the answer to this question is affirmative (YES), and then it is determined at a step S6 whether or not the comparator 44 is generating an output pulse. If the answer to this question is negative (NO), the program is immediately terminated, whereas if the answer is affirmative (YES), a count value CP of a CP counter is increased by an increment of 1 at a step S7, followed by terminating the program.

If the answer to the question of the step S3 is negative (NO), i.e. if $TR \geqq TRESET$ holds, the counter value CP of the CP counter is reset to 0 and the flag IG is reset to "0" at steps S4 and S5, followed by terminating the program.

According to the program of FIG. 7, the count value CP obtained is proportional to the comparison result pulse width TP. Alternatively of using the FIG. 7 program, the count value CP may be obtained by measuring the number of clock pulses generated while a comparison result pulse is generated, by means of a pulse counter.

Figure 8:
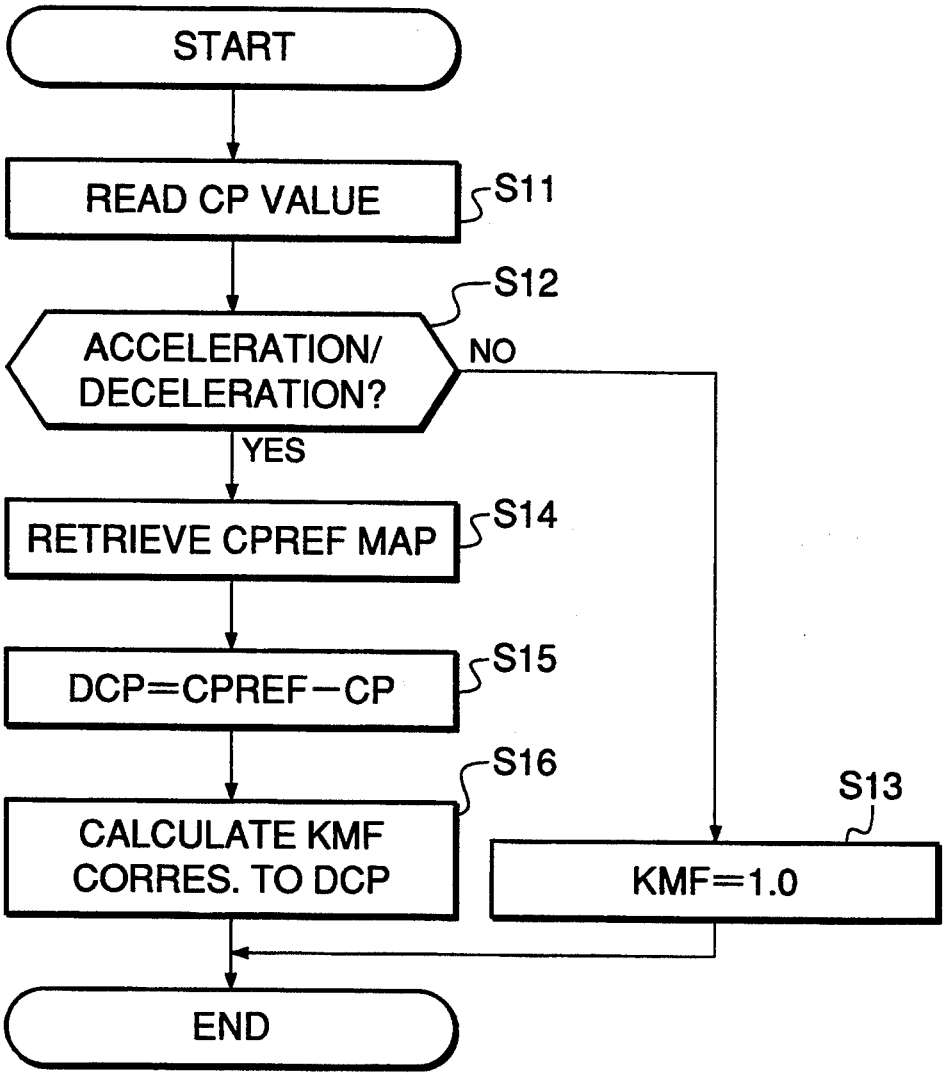
FIG. 8 is a flowchart showing a program for calculating a transient operation correction coefficient KMF.

FIG. 8 shows a program for calculating the transient operation correction coefficient KMF applied to the equation (1). This program is executed upon generation of each TDC signal pulse and in synchronism therewith.

First, at a step S11, the updated CP value obtained by the program of FIG. 7 is read in. Since the present program is executed in synchronism with generation of TDC signal pulses, CP values corresponding to respective cylinders are sequentially read in. At the next step S12, it is determined whether or not fuel supply control processing for acceleration or deceleration of the engine should be carried out. This determination is made in a known manner based upon the variation DTH in the throttle valve opening $\theta$TH and a variation DDTH in the variation DTH (difference between a present DTH value and an immediately preceding DTH value).

If the answer to the question of the step S12 is negative (NO), i.e. if the fuel supply control processing for acceleration or deceleration is not required, the correction coefficient KMF is set to 1.0 at a step S13, followed by terminating the program.

Figure 9:
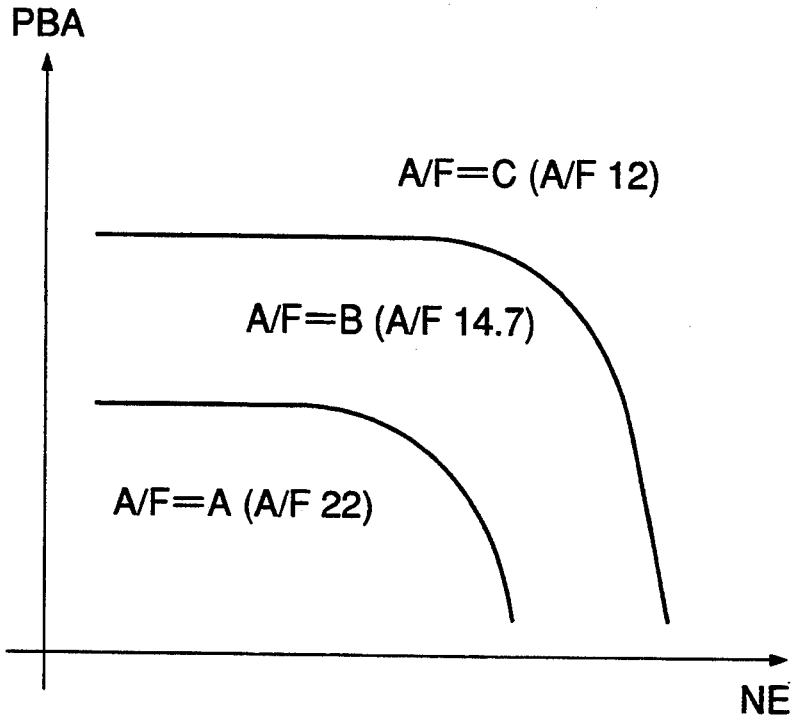
FIG. 9 is a graph showing the relationship between engine rotational speed NE and intake pipe absolute pressure PBA and a desired air-fuel ratio A/F.
Figure 10:
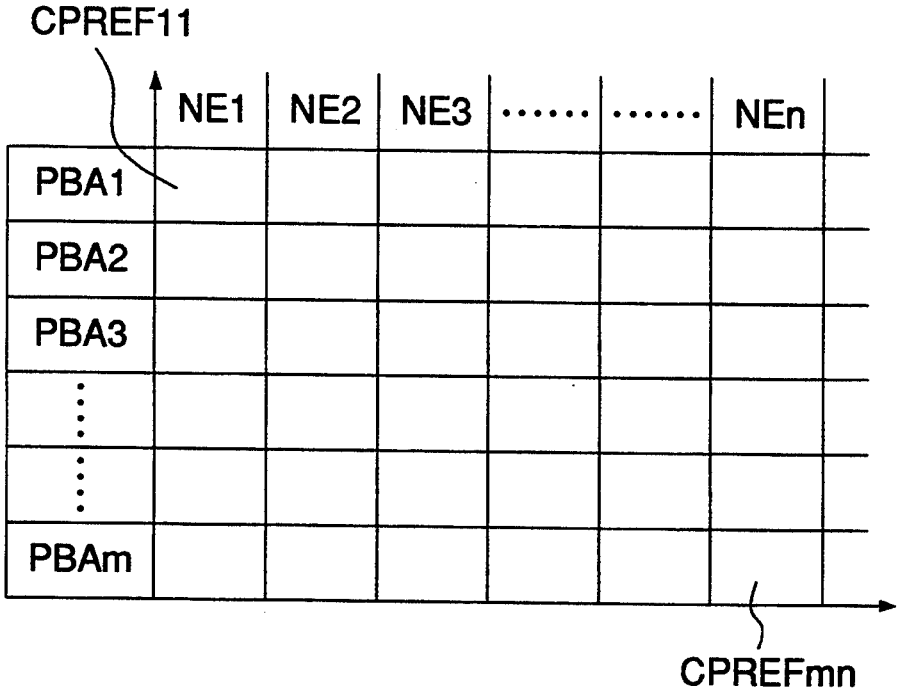
FIG. 10 shows a map for determining a reference count value CPREF.

If the answer to the question of the step S12 is affirmative (YES), i.e. if the the fuel supply control processing for acceleration or deceleration is required, a CPREF map is retrieved in accordance with the engine rotational speed NE and the intake pipe absolute pressure PBA to thereby calculate a basic value CPREF of the count value CP, at a step S14. The CPREF map is set as shown in FIG. 10, wherein predetermined CPREF values CPREF11–CPREFmn are provided, which correspond to respective different combinations of predetermined NE values NE1 . . . NEm and predetermined PBA values PBA1 . . . PBAn. The basic CP value CPREF corresponds to a desired air-fuel ratio A/F. That is, it is set to such a value as to attain a desired air-fuel ratio appropriate to an operating condition of the engine (engine rotational speed NE and intake pipe absolute pressure PBA). For example, as shown in FIG. 9, the CPREF map is prepared by experimentally determining CP values corresponding to desired air-fuel ratio values A, B, and C (=12.0, 14.7, and 22.0, respectively) appropriate to operating conditions of the engine determined by the engine rotational speed NE and the intake pipe absolute pressure PBA, and setting the thus determined CP values as basic values CPREF.

After determination of the CPREF value, a difference DCP between the determined CPREF value and the actually measured CP value is calculated by the following equation (3), at a step S15:

$$DCP = CP - CPREF \quad (3)$$

Figure 11:
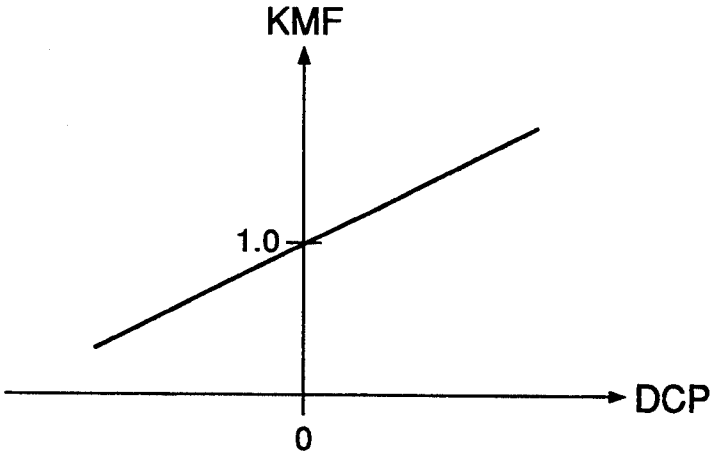
FIG. 11 shows a table for determining the transient operation correction coefficient KMF.

Then, a value of the transient operation correction coefficient KMF is calculated, which corresponds to the calculated DCP value, at a step S16, followed by terminating the program. The KMF value is calculated as shown in FIG. 11, wherein when DCP=0, the KMF value KMF is set to 1.0, and the KMF value is set to larger values as the DCP value increases.

More specifically, when DCP>0 holds, which means that the actual air-fuel ratio A/F deviates from the desired air-fuel ratio toward the leaner side, the KMF value is set to a value greater than 1.0 to thereby increase the fuel supply amount, whereas when DCP<- holds, which means that the actual air-fuel ratio A/F deviates toward the richer side, the KMF value is set to a value smaller than 1.0 to thereby decrease the fuel supply amount.

Figure 1A:
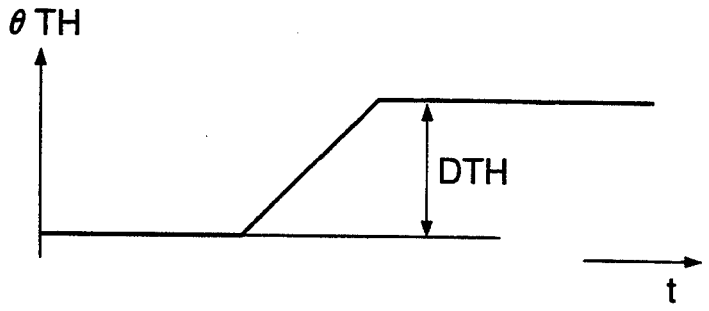
Figure 1B:
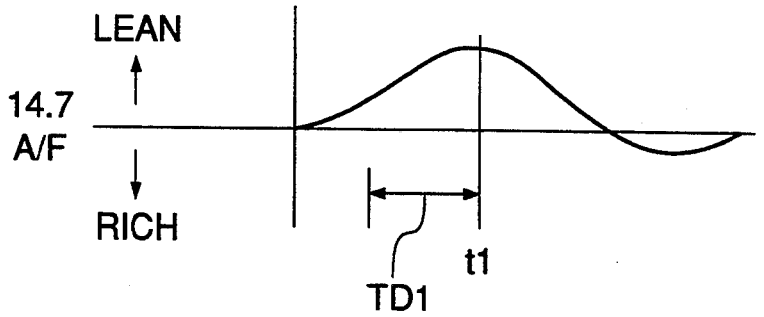
Figure 1C:
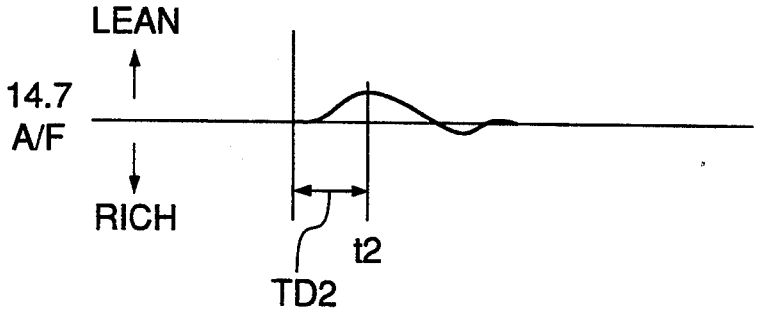

According to the present embodiment, by thus setting the transient operation correction coefficient KMF in response to the amount of combustion ions generated within the engine cylinder, the air-fuel ratio of a mixture supplied to the engine changes as shown in FIG. 1 (*c*), for example. As compared with a change in the air-fuel ratio according to the prior art shown in FIG. 1 (*b*), it is seen that the deviation of the actual air-fuel ratio A/F from the desired air-fuel ratio (=14.7) can be greatly reduced. This is because according to the manner of the present invention, the CP value can be detected at an early time point t2 after a very short time lag TD2 which corresponds to a time period required for completion of a spark ignition, i.e. combustion within the cylinder. As a result, the responsiveness or response speed of the air-fuel ratio feedback control can be greatly enhanced.

Since detection of the air-fuel ratio based upon the CP value can be made for each of the cylinders, it is possible to carry out the air-fuel ratio feedback control with respect to each cylinder.

Although in the above described embodiment the air-fuel ratio is detected based upon the CP value corresponding to the comparison result pulse width TP which is a time period over which the sparking voltage exceeds a predetermined value, this is not limitative. For example, the air-fuel ratio may be detected based upon an amount by which the sparking voltage exceeds a predetermined value. Further, any other parameter which can represent the amount of combustion ions generated within the engine cylinders is applicable to the invention, such as sparking voltage value per se, sparking current value per se, a value indicative of an area of a portion of the sparking voltage or the sparking current which exceeds a predetermined value, and a time period or an amount over or by which the sparking voltage value exceeds a predetermined value.

As described above, according to the invention, when the engine is in a transient operating condition, the fuel supply amount is corrected in response to an amount of combustion ions generated within the engine cylinder. As a result, the responsiveness of the air-fuel ratio feedback control can be greatly enhanced as compared with the conventional method of correcting the fuel supply amount in response to an output from an oxygen concentration sensor, thereby enabling to greatly reduce deviation of the actual air-fuel ratio of a mixture supplied to the engine from a desired predetermined value and hence enabling to improve the drivability of the engine and exhaust emission characteristics thereof at acceleration and deceleration of the engine.

What is claimed is:

1. A fuel supply control system for controlling an amount of fuel supplied to an internal combustion engine having at least one cylinder, comprising:

combustion ion-detecting means for detecting a value related to an amount of combustion ions generated within said at least one cylinder;

engine operating condition-detecting means for detecting whether said engine is in a transient operating condition; and correcting means for comparing the value related to said amount of combustion ions detected by said combustion ion-detecting means with a predetermined value and for correcting an amount of fuel supplied to said engine, based upon a result of the comparison, when it is detected that said engine is in said transient operating condition.

2. A fuel supply control system for controlling an amount of fuel supplied to an internal combustion engine having at least one cylinder, and an ignition system having a spark plug mounted in each of said at least one cylinder, signal-generating means for generating an ignition command signal indicative of ignition timing dependent upon operating conditions of said engine, and sparking voltage-generating means responsive to said ignition command signal for generating sparking voltage in said at least one cylinder for discharging said spark plug, the fuel supply control system comprising:

voltage value-detecting means for detecting a value of said sparking voltage generated by said sparking voltage-generating means in response to said ignition command signal;

measuring means for measuring an extent to which the value of said sparking voltage detected by said voltage-detecting means exceeds a first predetermined value; and correcting means for comparing said extent measured by said measuring means with a second predetermined value, and for correcting an amount of fuel supplied to said engine, based upon a result of the comparison.

3. A fuel supply control system as claimed in claim 2, wherein said extent to which the detected value of said sparking voltage exceeds said first predetermined value is a time period over which the former exceeds the latter.

4. A fuel supply control system as claimed in claim 2, wherein said extent to which the detected value of said sparking voltage exceeds said first predetermined value is an amount by which the former exceeds the latter.

5. A fuel supply control system as claimed in any of claims 2–4, wherein said second predetermined value is set in dependence on operating conditions of said engine.

6. A fuel supply control system as claimed in any of claims 2–4, including means for determining a basic value of said amount of fuel supplied to said engine, based upon predetermined operating parameters of said engine, and wherein said correcting means corrects said basic value of said amount of fuel supplied to said engine, by the use of a correction coefficient determined by a result of the comparison between said extent to which the detected value of said sparking voltage exceeds said first predetermined value and said second predetermined value.

* * * * *